US006773007B2

(12) United States Patent
Sheng et al.

(10) Patent No.: US 6,773,007 B2
(45) Date of Patent: Aug. 10, 2004

(54) PAPER FEEDING DEVICE HAVING REPLACEABLE PAPER CONVEYING ROLLER FOR A PRINTER

(75) Inventors: Thomas Sheng, Hsinchu (TW); Szu-Hui Lien, Hsinchu (TW)

(73) Assignee: Avision, Inc., Hsinchu (TW)

( * ) Notice: Subject to any disclaimer, the term of this patent is extended or adjusted under 35 U.S.C. 154(b) by 7 days.

(21) Appl. No.: 10/357,075

(22) Filed: Feb. 5, 2003

(65) Prior Publication Data

US 2003/0122298 A1 Jul. 3, 2003

Related U.S. Application Data

(62) Division of application No. 09/766,998, filed on Jan. 23, 2001, now Pat. No. 6,488,276.

(51) Int. Cl.[7] ..... B65H 3/06
(52) U.S. Cl. ..... 271/109; 271/264; 271/314
(58) Field of Search ..... 271/109, 264, 271/113, 314; 492/30, 57, 59, 60

(56) References Cited

U.S. PATENT DOCUMENTS

| | | | | | |
|---|---|---|---|---|---|
| 4,473,221 | A | * | 9/1984 | Arai | 271/109 |
| 4,729,557 | A | * | 3/1988 | Kiyohara | 271/272 |
| 5,421,569 | A | * | 6/1995 | Davidson | 271/109 |
| 6,488,276 | B2 | * | 12/2002 | Sheng et al. | 271/18 |

FOREIGN PATENT DOCUMENTS

| | | | | |
|---|---|---|---|---|
| GB | 2132737 A | * | 7/1984 | F16C/13/00 |
| JP | 61203037 | * | 8/1986 | |
| JP | 43753 | * | 8/1992 | |

* cited by examiner

*Primary Examiner*—David H Bollinger
(74) *Attorney, Agent, or Firm*—H. C. Lin, Patent Agent

(57) ABSTRACT

A replaceable friction roller is mounted on the driving shaft of a paper conveying roller. The roller is made replaceable by providing a slit from the surface of the roller to the shaft surface. The roller can be split open along the cur when replacing a new roller. The ends of the shaft of the roller are inserted in at least one open mouth socket. The socket has spring action to hold the shaft in place.

1 Claim, 12 Drawing Sheets

PAPER FEEDING DEVICE HAVING REPLACEABLE PAPER CONVEYING ROLLER FOR A PRINTER

This application is a division of application Ser. No. 09/766,998, filed Jun. 23, 2001, now issued as U.S. Pat. No. 6,488,276, Dec. 3, 2002.

BACKGROUND OF THE INVENTION (1) Field of the Invention

This invention relates to a printer, particularly to he conveying roller of the printer.

(2) Brief Description of Related Art

Prior art has been using a roller to convey paper in a printer, as shown in FIG. 1. A metal back shell 10 wraps around two brackets 11, 12, which reinforce the shell. The brackets 11 and 112 each have two sockets 121 and 122 respectively for mounting a shaft 15. A roller 16, made of friction material, is mounted over the shaft 15. The left side 18 of the shaft 15 feeds through the socket 112, and the right side of the shaft 15 feeds through the socket 122. The axle is driven by a gear 17 located at the right end of the axle 15. When the gear 17 is driven by a motor (not shown), the roller 15 rotates and the friction coveys the paper P forward.

Due to high speed operation of modem printers, the roller 16 experiences wear and tear. The life of the printer is thus adversely affected.

SUMMARY OF THE INVENTION

An object of this invention is to increase the useful life of a printer. Another object is to reduce servicing coast of a printer.

These object is achieved by using a replaceable roller for a printer. A replaceable friction roller is mounted on the driving shaft of a paper conveying roller. The roller is made replaceable by providing a slit from the surface of the roller to the shaft surface. The roller can be split open along the cut when replacing a new roller. The ends of the shaft of the roller are inserted in at least one open mouth socket. The socket has spring action to hold the shaft in place.

DETAILED DESCRIPTION OF THE INVENTION

Figure 2:
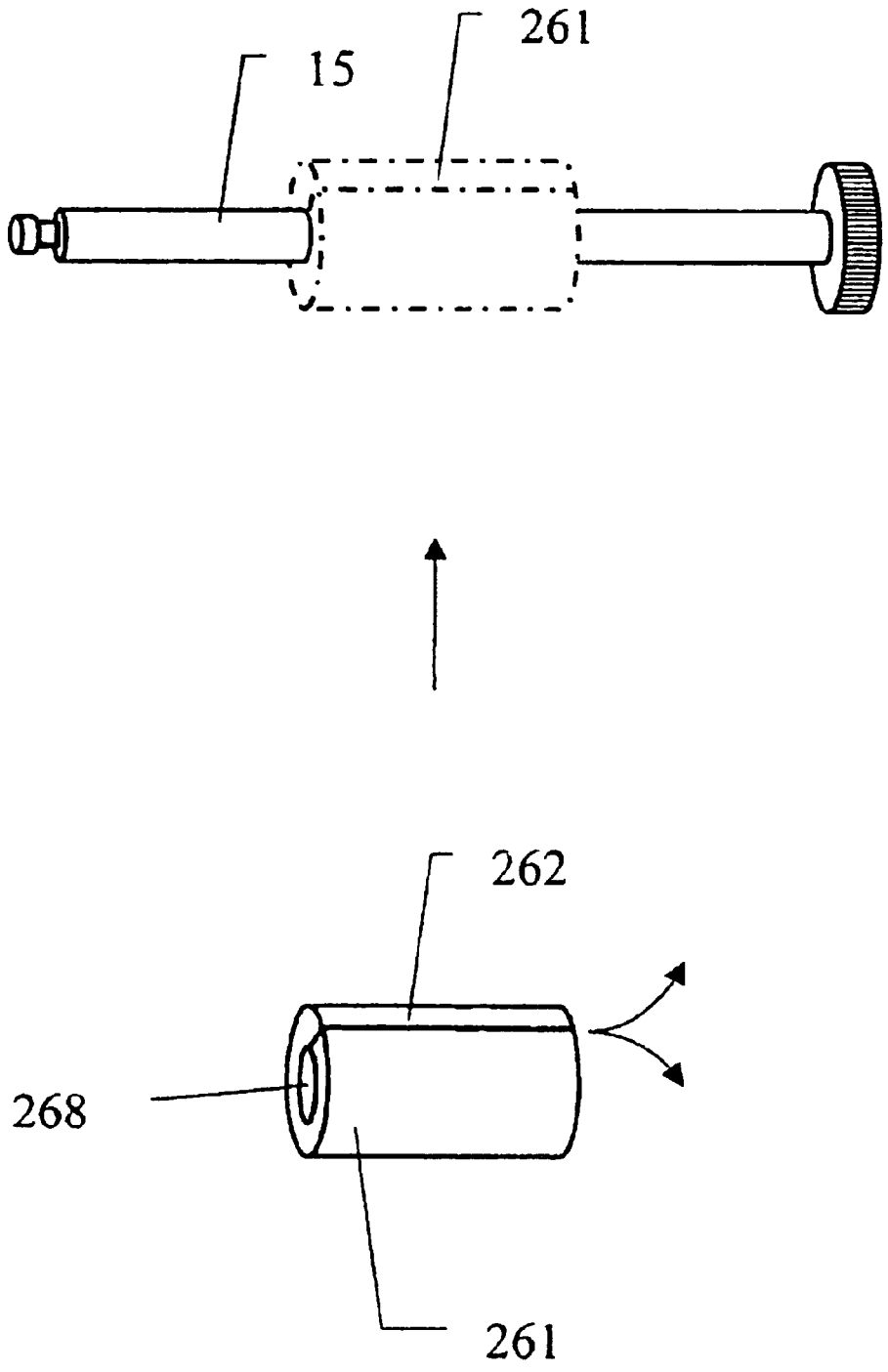
FIG. 2 shows the first embodiment of the conveying roller of the present invention.

FIG. 2 shows a replaceable conveying friction roller 261 based the present invention. The roller 261 has a cut 262 from the rim to the edge of a hole 268, which wraps around the shaft 15. The cut allows the friction roller 261 to split along the cut for mounting over or removal from the shaft 15.

Figure 3:
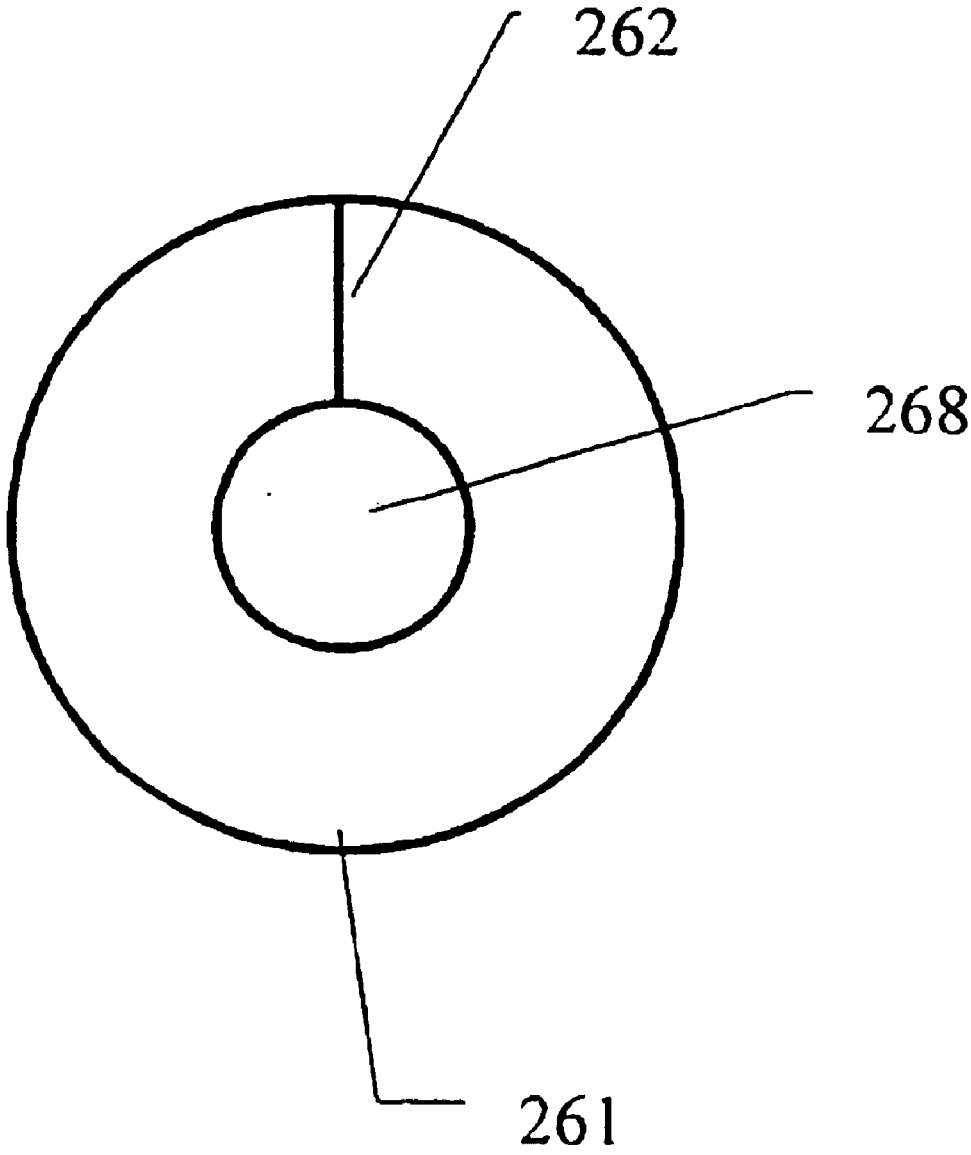
FIG. 3 shows the side view of the FIG. 2.

FIG. 3 shows the end view of the removable friction roller 262 with a cut 262.

Figure 4:
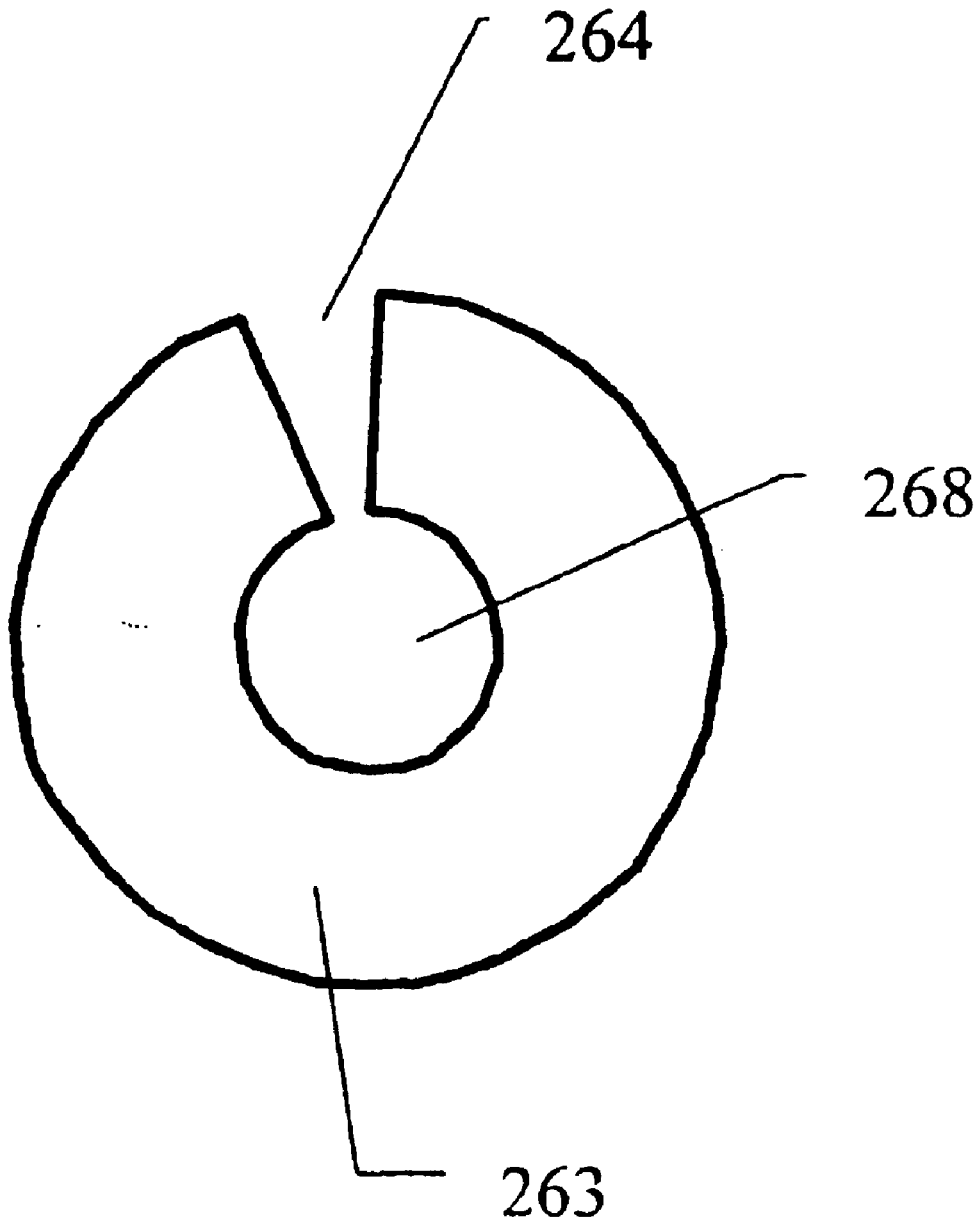
FIG. 4 shows a second embodiment of the conveying roller of the present invention.

FIG. 4 shows a second embodiment of removable friction roller 263, which has a V-shaped cut 264 and a hole 268. While the cut shown as V-shaped, the cut can of other shapes, such a rectangular cut, an arc shaped cut, an S-shaped cut or any other regular or irregular cut.

Figure 5:
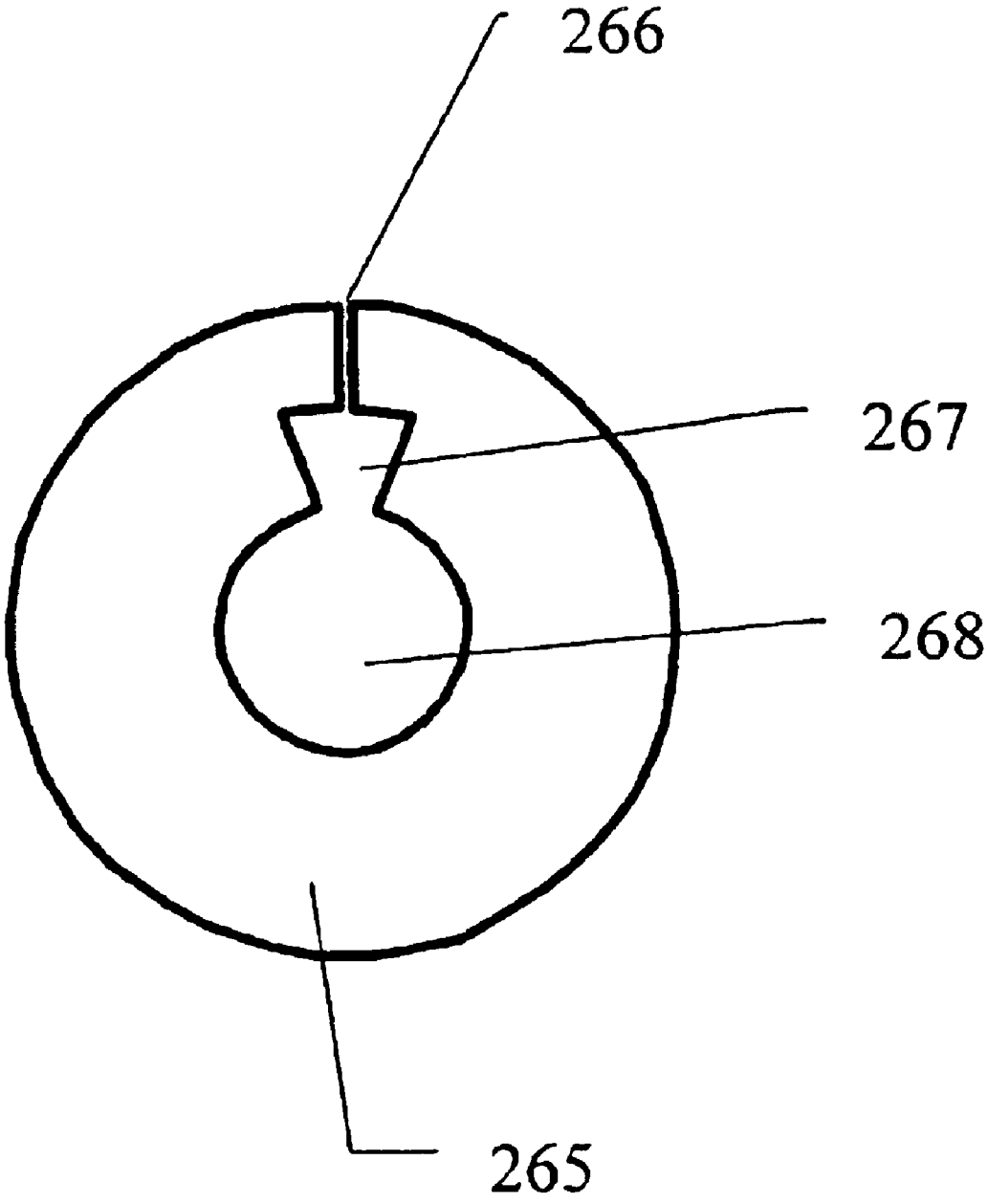
FIG. 5 shows a third embodiment of the conveying roller of the present invention.

FIG. 5 shows a third embodiment of the removable friction roller 265. The roller has a cut 266 from the surface of the roller halfway toward the center of the roller. The cut is then enlarged into a dovetailed cut toward the center. The narrow cut near the surface of the roller is to facilitate complete rubbing the friction roller over the paper. The enlarged cut 267 toward the center is to facilitate removal of the roller from the axle for replacement.

Figure 1:
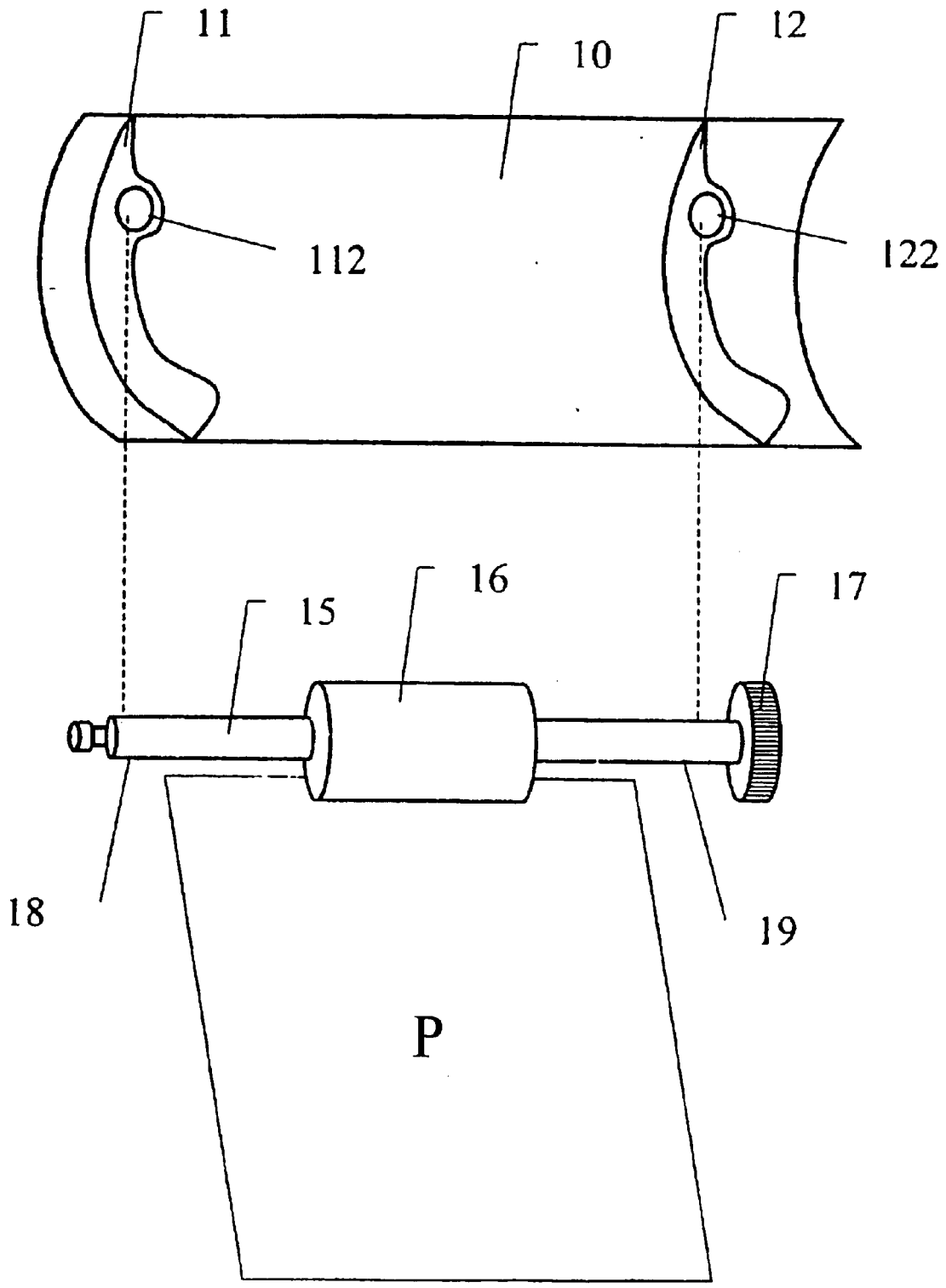
Fig. 1. Prior Art
FIG. 1 shows a prior art conveying roller for a printer.
Figure 6:
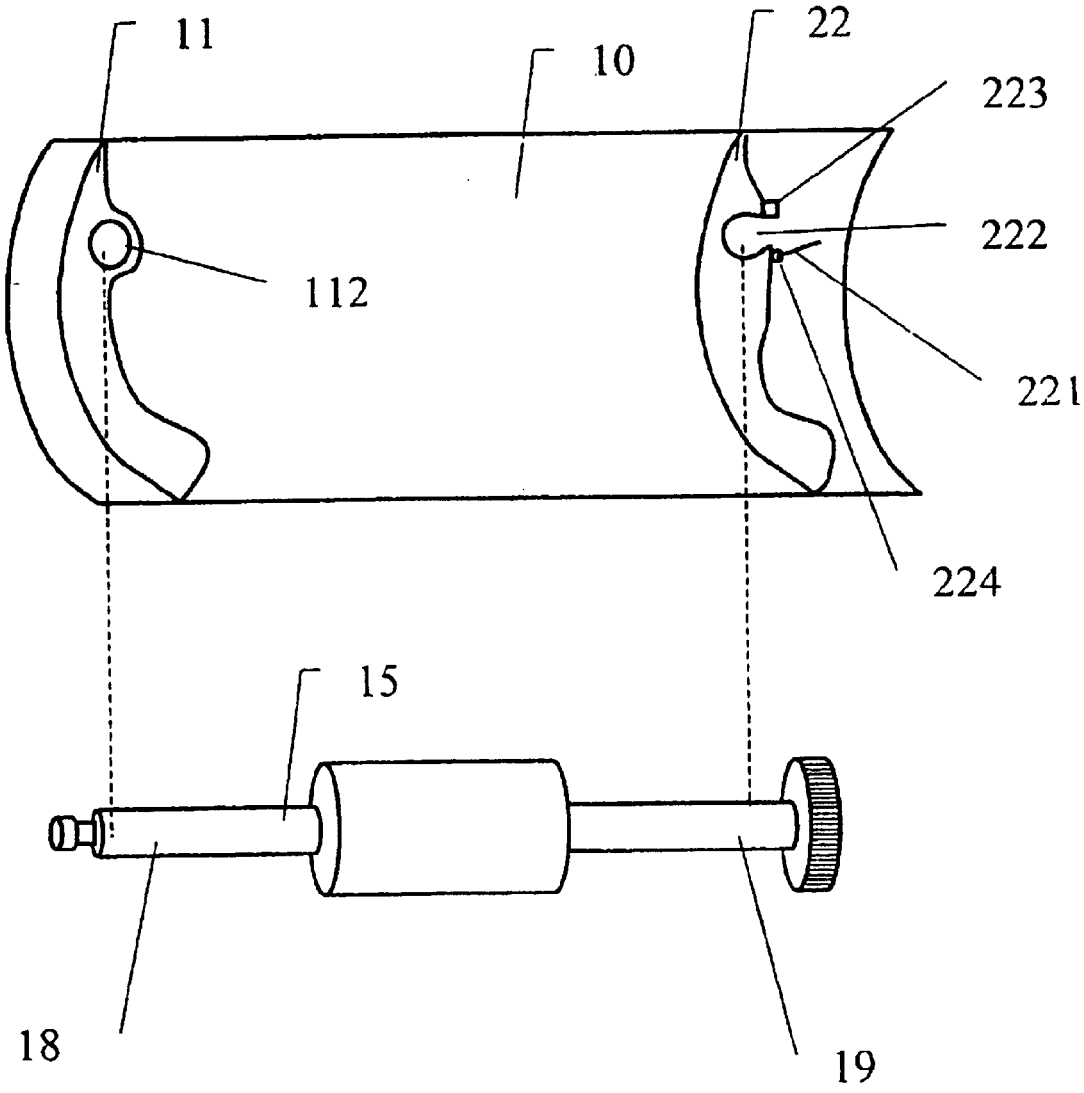
FIG. 6 shows an open-ended socket on one of the supporting brackets.

FIG. 6 shows a first embodiment of the sockets on the brackets 11, 22 mounted on the back shell 10. The socket 112 is located in the bracket 11 as in FIG. 1. The socket 222 on the bracket 22 is open-ended for facilitating the insertion and removal the axle 15 of the friction roller. The left end 18 of the axle 15 for mounting the roller is inserted in the socket 112. The right end 19 of the axle is inserted into the mouth of the open-ended socket 222. After the axle is inserted, the mouth is closed by a shutter 221 pivoted at point 224 and hooked at point 223.

Figure 7:
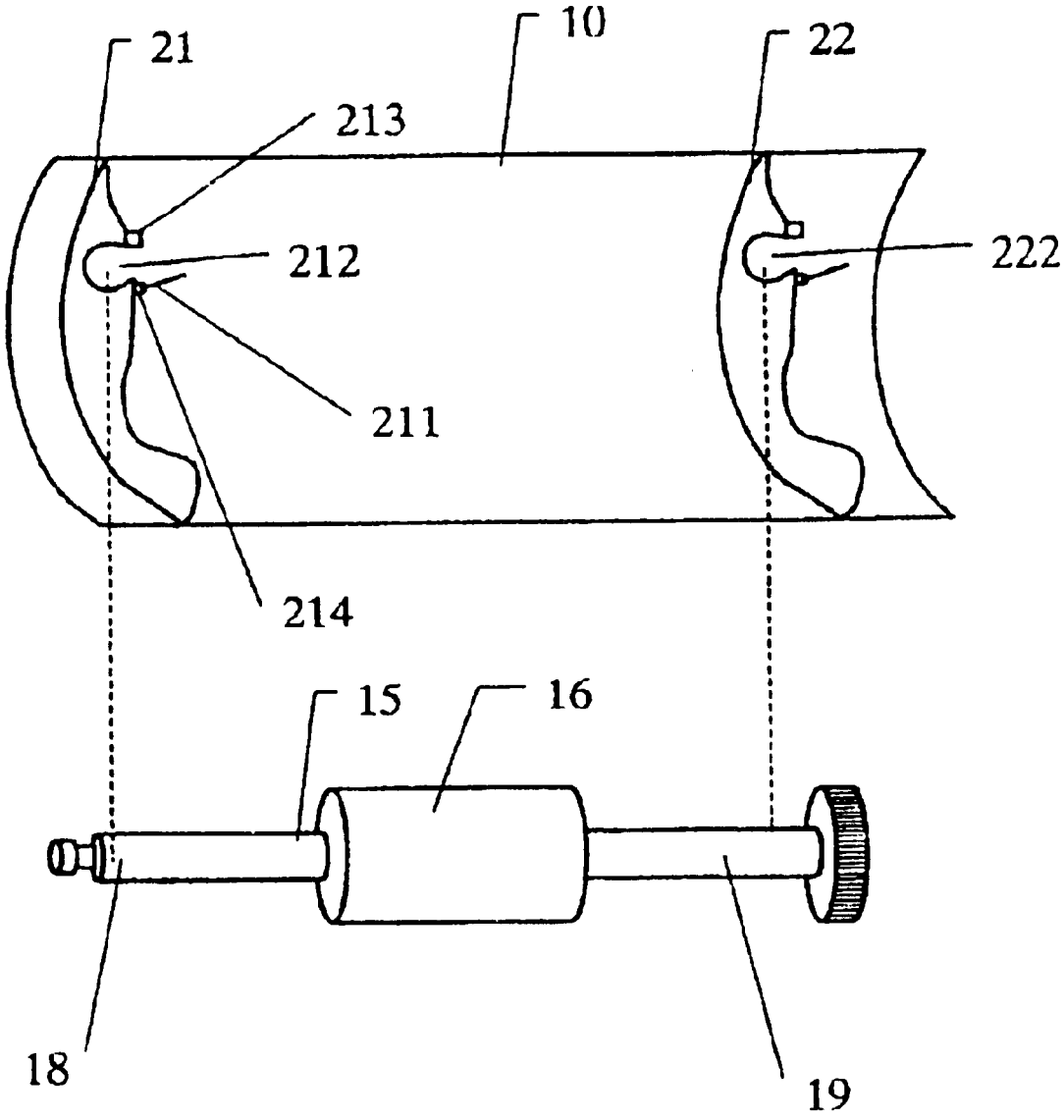
FIG. 7 shows two open-ended sockets on two respective supporting brackets.

FIG. 7 shows a second embodiment of the sockets of the brackets 21, 22 mounted on the shell 10. Both sockets 212 and 222 are open-ended as the pinhole 112 in FIG. 6 to facilitate insertion and removal the shaft 15. As in socket 222, the socket 212 at the left end has an open mouth which can be closed by a shutter 211 in the form of a bar, which is pivoted at point 214 and hooked by a catch at point 213.

Figure 8:
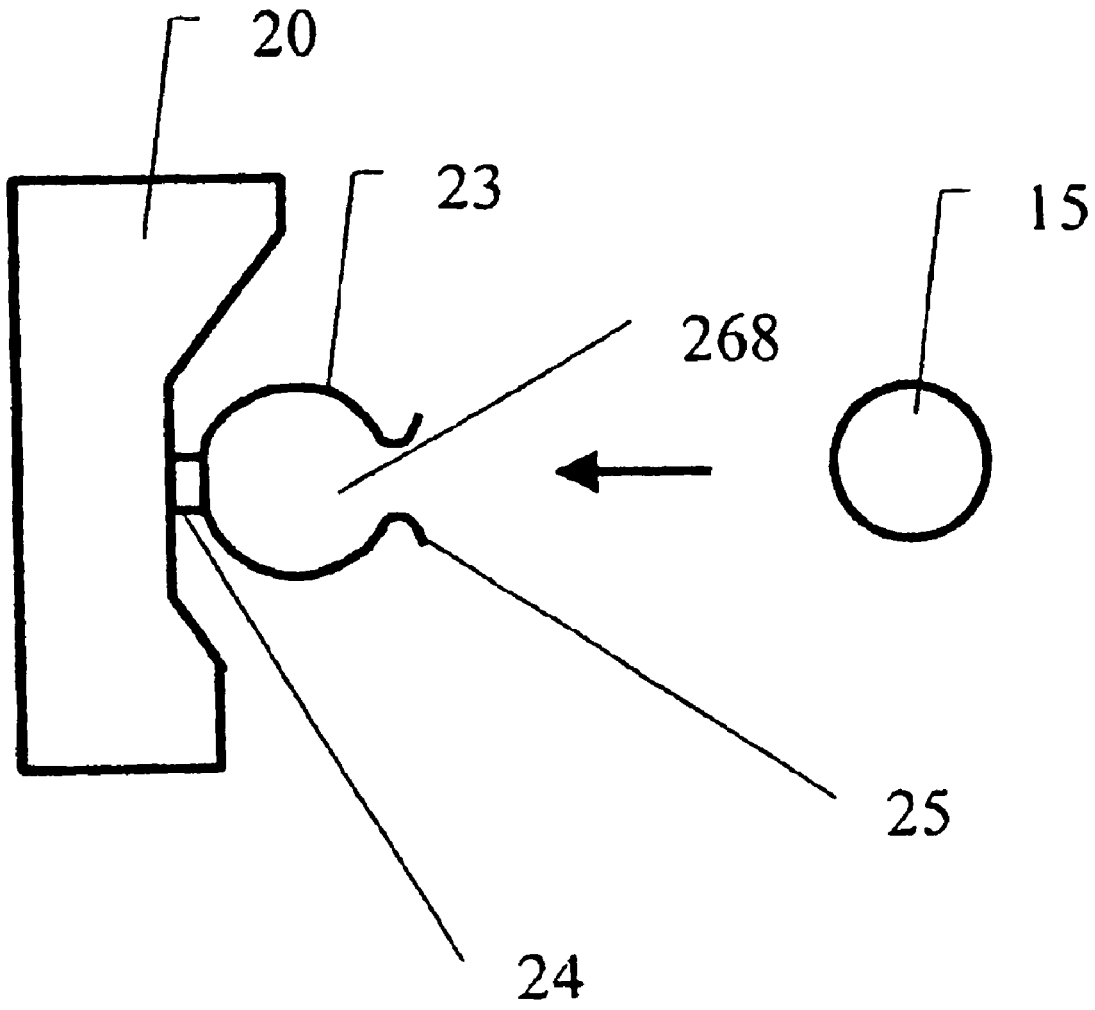
FIG. 8 shows an open-ended socket with two C-shaped springs.

FIG. 8 shows a first version of a socket 268 which has two C-shaped springs 23, 25 mounted to a back plate 20 through a fixed neck 24. The shaft 15 of the roller can be inserted into the socket 268 to hold the roller in place and can be easily removed from the socket 268 for replacement.

Figure 9:
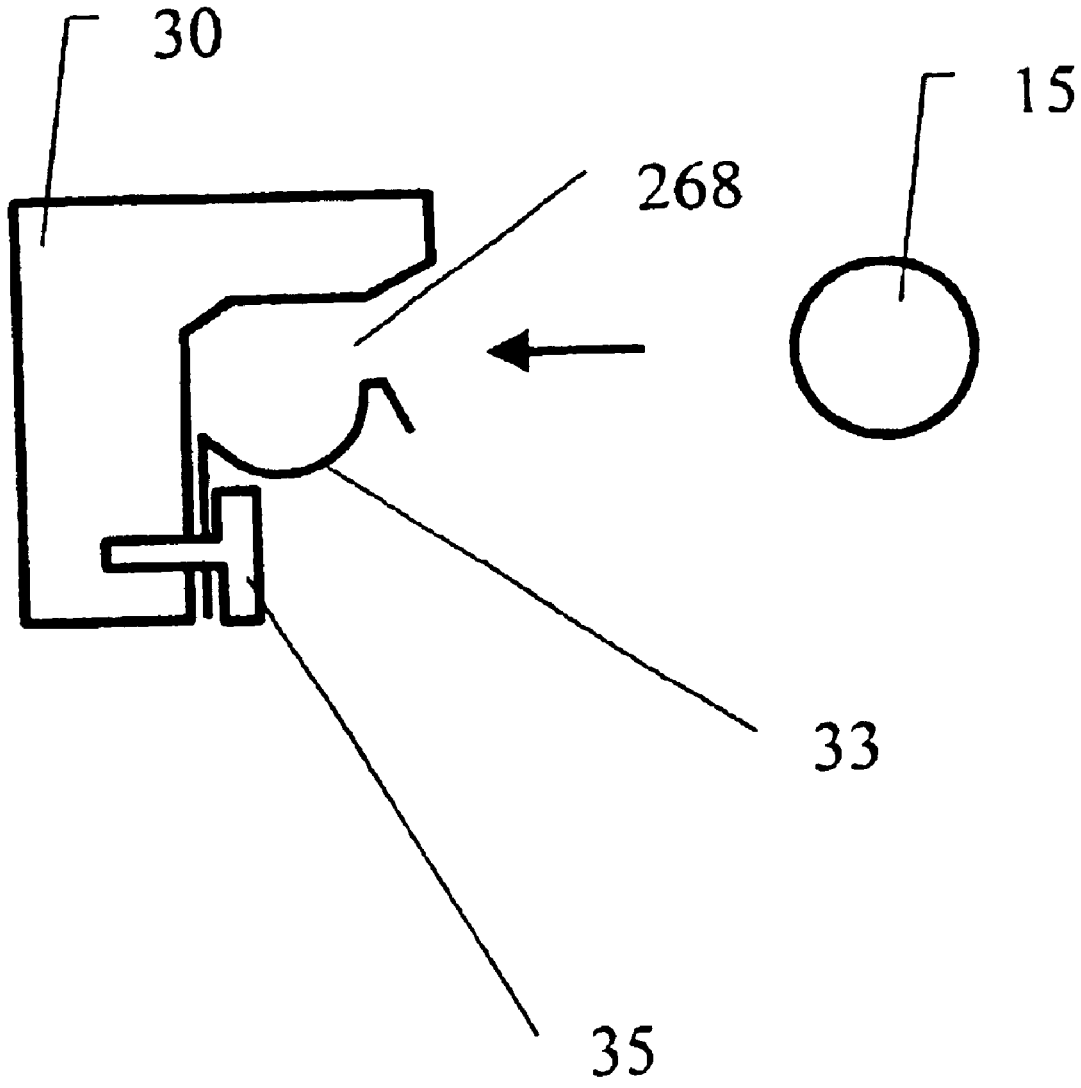
FIG. 9 shows an open-ended socket with one C-shaped spring pressing against a rectangular bracket.

FIG. 9 shows a second version of a socket 268, which has one C-shaped spring 33 mounted to a rectangular back plate 30 through a screw 35. The shaft 15 of the roller can be inserted into the socket 268 to hold the roller in place and can be easily removed from the socket 268 for replacement.

Figure 10:
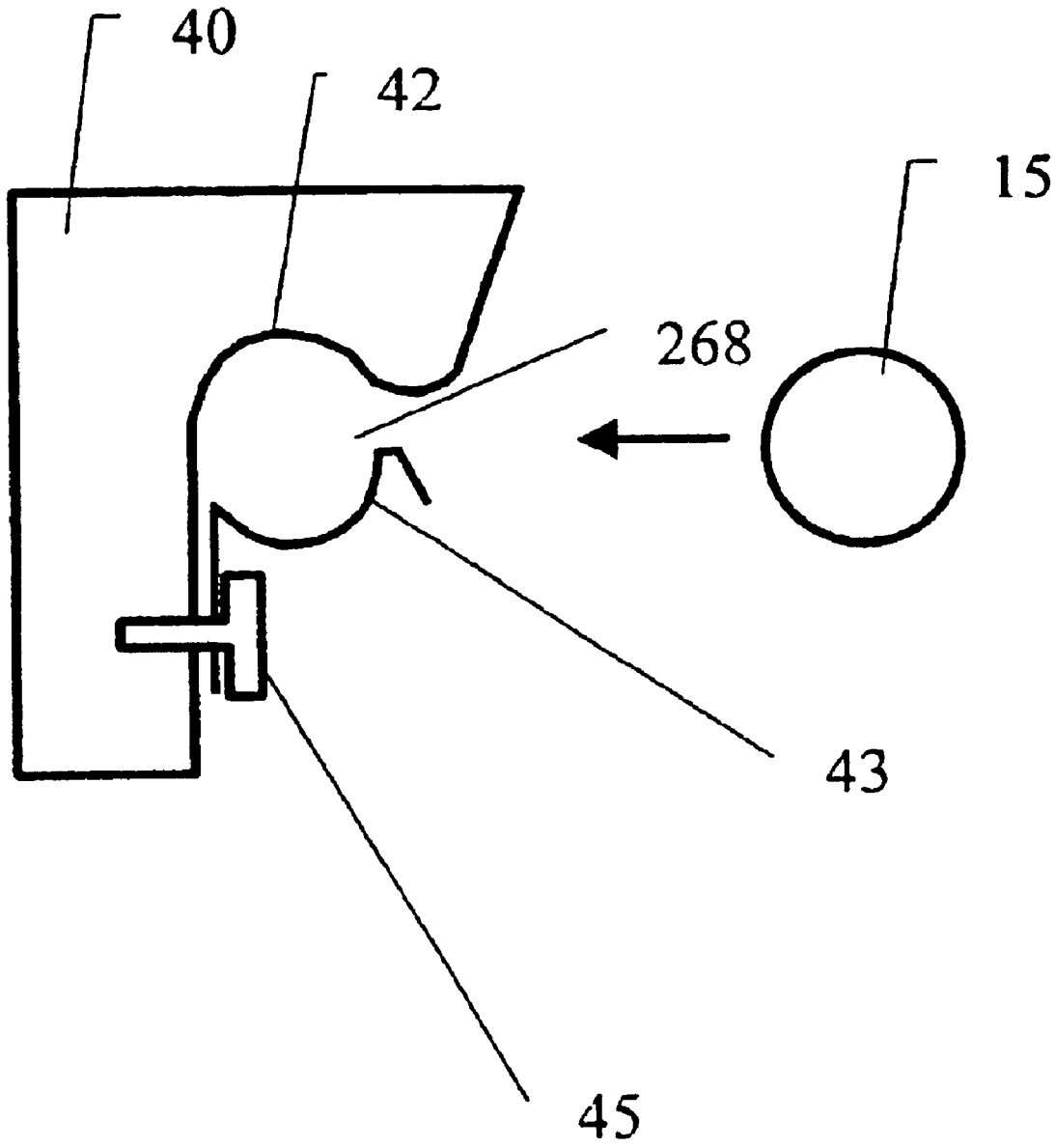
FIG. 10 shows an open-ended socket with a C-shaped spring pressing against curved bracket.

FIG. 10 shows a third version of a socket of a socket 268, which has one C-shaped spring mounted against back plate 40 with an arc-shaped contour 42 through a screw 45. The shaft 15 of the roller can be inserted snugly into the socket 268 to hold the roller in place and can be easily removed from the socket 28 for replacement. As shown, the C-shaped spring presses the shaft 15 against the plate 30 as a wall.

Figure 11:
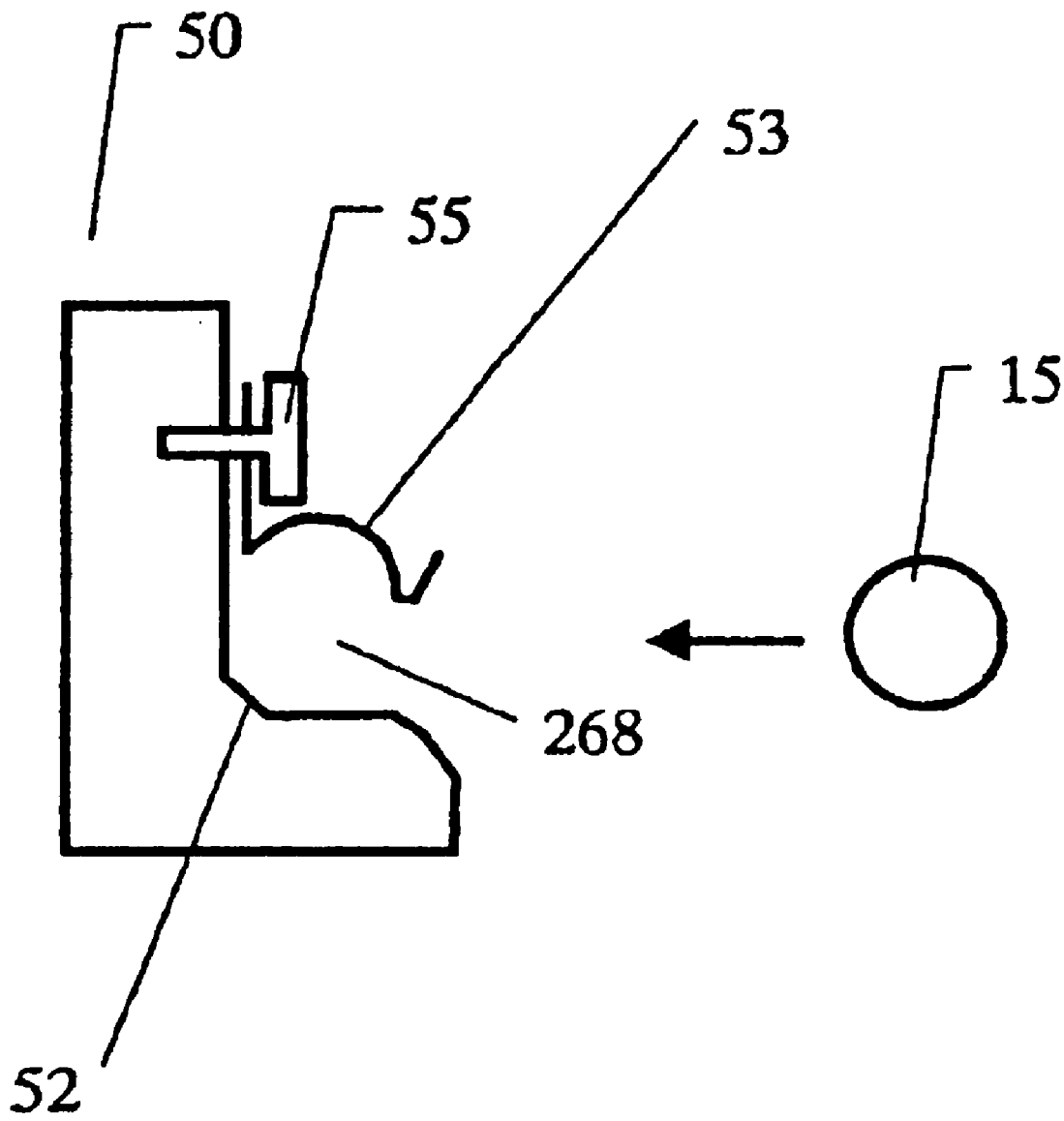
FIG. 11 shows an open-ended socket inverted from that shown in FIG. 9.

FIG. 11 shows a fourth version of the socket 268, which has an inverted structure as that shown in FIG. 9. The socket 268 has one C-shaped spring 53 mounted to a rectangular back plate 50 through a screw 55. The shaft of the roller can be inserted into the socket 268 to hold the roller in place and can be easily removed from the socket 268 for replacement.

Figure 12:
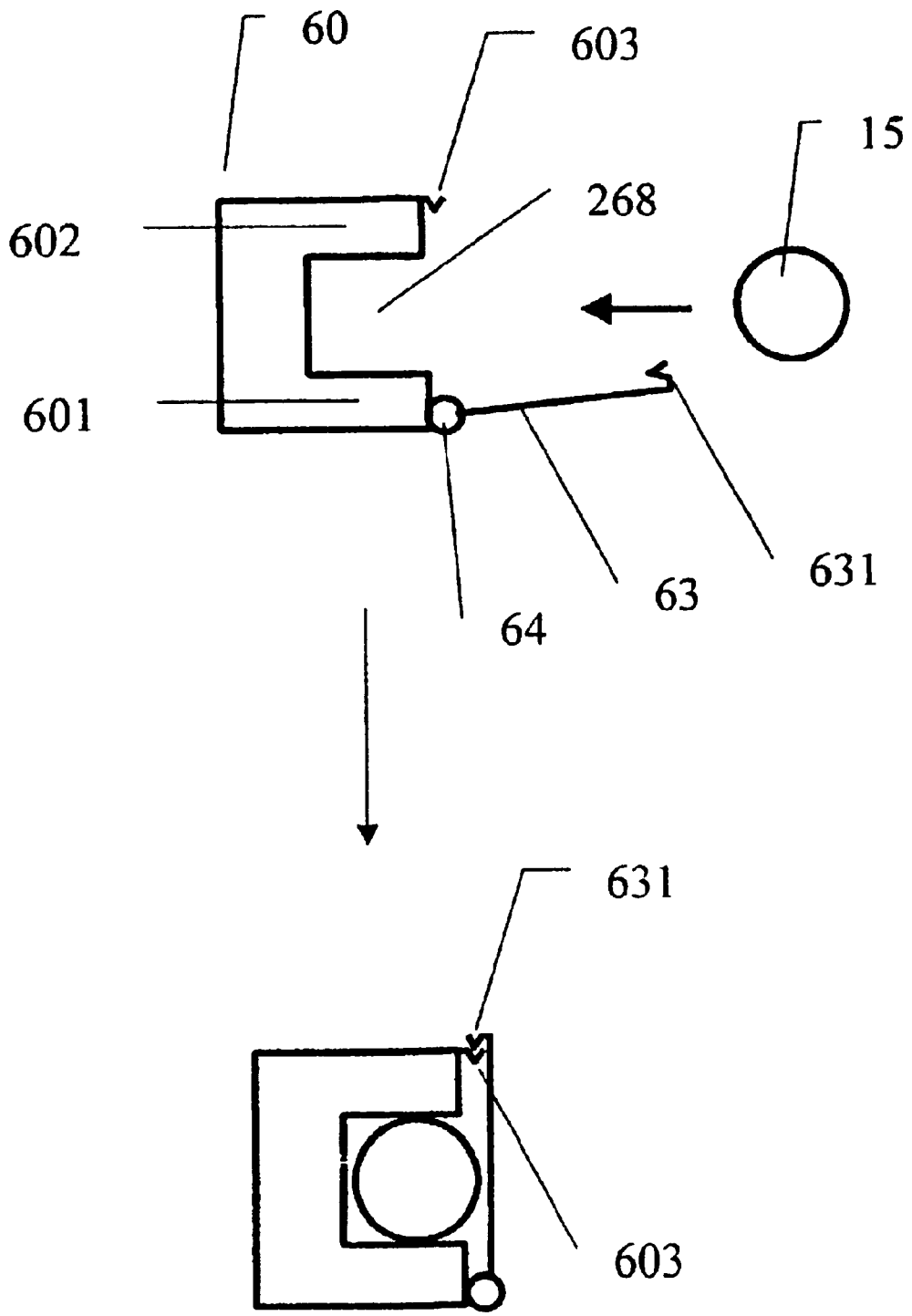
FIG. 12 shows a fifth version of the socket.

FIG. 12 shows a fifth version of the socket 268, which has a rectangular recess in the back plate 60. The recess forms two jaws 601 and 602. The mouth of jaws 601, 602 has a door 63, which is hinged at the lower jaw 601 at point 64. After the shaft 15 of the roller is inserted into the mouth of the socket, the door is closed and latched by the mating springs 603 and 603. The shaft can easily be inserted in place and removed from the socket for replacement.

While the preferred embodiments of the invention have been described, it will be apparent to those skilled in the art that various modifications may be made in the embodiments without departing from the spirit of the present invention. Such modifications are all within the scope of this invention.

What is claimed is:

1. A paper conveying mechanism for a printer, comprising:

a back plate;

a friction roller for conveying a piece of paper;

a shaft for mounting said friction roller;

an attachment for attaching said shaft to said back plate; and a cut from the outer surface of said roller to the inner surface wrapping around the shaft so that the roller can be split along the cut for removal from said shaft, wherein said cut comprises a straight slit near the surface of the roller and a dovetailed cut near the surface of the shaft.

* * * * *